United States Patent [19]

Drobnik et al.

[11] 4,135,569

[45] Jan. 23, 1979

[54] MOLDING MACHINE CLEAN OUT

[75] Inventors: Leszek R. Drobnik; Edward J. Rebish, both of Euclid, Ohio

[73] Assignee: Acme-Cleveland Corporation, Cleveland, Ohio

[21] Appl. No.: 815,230

[22] Filed: Jul. 13, 1977

[51] Int. Cl.[2] ..... B22C 15/22

[52] U.S. Cl. ..... 164/158; 222/148; 164/200

[58] Field of Search ..... 164/21, 22, 150, 200, 164/158; 222/148

[56] References Cited

U.S. PATENT DOCUMENTS

| | | | |
|---|---|---|---|
| 3,528,481 | 9/1970 | Lund | 164/200 X |
| 3,590,906 | 7/1971 | Bayless et al. | 164/200 |
| 3,822,737 | 7/1974 | Edwards | 164/158 |

*Primary Examiner*—Robert L. Spicer, Jr.
*Attorney, Agent, or Firm*—Woodling, Krost, Granger & Rust

[57] ABSTRACT

A molding machine for use with quick setting and cold setting sticky mold material, a mixture of sand and self-setting adhesive, is provided with a device to clean out the machine during each cycle and after the blow operation is completed. The sand and adhesive is mixed with the catalyst to a condition so that it will set up in a matter of seconds, e.g. ten to sixty seconds, and as it is mixed, a predetermined quantity is immediately deposited in a magazine. The magazine is closed by a valve and air pressure is applied to blow the sticky mold mixture from the magazine through a blow head into a mold cavity wherein it immediately starts to set. A diverter is provided with a diverter passage just outboard of the blow apertures of the mold box and this diverter passage is next enabled and air pressure is again applied through the magazine and blow head to blow any small amount of excess sticky mold mixture out the diverter passage into a receptacle. Air jets directed tangentially and downwardly in the sand magazine help move the entire slug of sticky mold material downwardly out of the magazine to clean the magazine and the enabled diverter passage cleans all of the excess material not used in that cycle. The diverter is disabled, the completed mold is removed from the mold, the mold box closed and the cleaned machine then is ready for the next cycle of operation. The forgoing abstract is merely a resume of one general application, is not a complete discussion of all principles of operation or applications, and is not to be construed as a limitation on the scope of the claimed subject matter.

16 Claims, 7 Drawing Figures

MOLDING MACHINE CLEAN OUT

BACKGROUND OF THE INVENTION

Many foundry mold making machines have been devised to make molds of a mold material, principally sand and a binder. Usually the mold material was baked or heated in order to harden the mold to have it retain the desired shape. In recent years a thermosetting binder was utilized so that when heat was applied the resulting sand mold became quite hard. More recently cold setting mold materials were used wherein the adhesive in the sand mix was cured by passing a catalyst gas through the mold within the mold box. In both the thermosetting and the cold setting with catalyst gas processes, it was not particularly important to observe any special precautions about the already mixed sand and binder waiting in a sand magazine for the next cycle of operation. Since neither heat nor catalyst gas was applied to the sand magazine, the sand and adhesive mixture therein did not set up. As a result it was common practice to retain a fairly large quantity of sand and adhesive mixture in the magazine after each filling of the mold box.

In more recent years there has been a tendency to try to avoid use of heat in the setting of the mold within the mold box because this required energy and also made the molds and the entire mold making machine hot thereby establishing a safety hazard for workers handling the finished molds. Also in recent years there has been the desire to avoid use of the catalyst gas since most of these gasses are toxic thus presenting another safety hazard and the spent catalyst gas must be disposed of in a safe manner. If it was burned to render it non-toxic the amount of fuel gas necessary to burn the catalyst gas was as much or more than the amount of gas utilized in the thermosetting process, and was therefore also wasteful of energy.

The more recent self-setting adhesives may be ones wherein the sand was mixed with a two part liquid, a binder and catalyst, so that the complete mixture began to set or cure within a matter of seconds, e.g. ten to sixty seconds. This meant that the sand and self-setting adhesive had to be promptly moved into the mold box before it had a chance to set-up in the mixer or in the magazine. The formerly used screw type mixers were usually too slow because the sand and adhesive mixture had too long a transit time within the screw mixer. Also many machines would fill some kind of a container with a premeasured amount of sand and this container would then be moved into a blow position wherefrom it was blown into the mold box after being clamped to the mold box. All this took time for the movement of the container and the clamping and the mixture would tend to set-up in the container. Also because the mixture was usually a sticky mixture due to the liquid adhesive and catalyst, it was difficult to fill the container with a precise amount of sand and it was difficult to make sure that all of this sand was blown out of the container into the mold box. The sand mold might be either a cope or drag mold or it might be a core for use within the cope and drag mold. Where it was a core there was a special problem because if not enough sand and adhesive mixture were supplied to fill the core box, then the core would be undersize and the resulting metal casting would be oversize to wrongfully fill a desired cavity and thus the casting would be scrap rather than usable.

The quantity of sand blown from the container into the mold box was subject to many variables including the accuracy of dispensing the sand from the mixing device, the stickiness of the sand mixture and the amount of air pressure available for blowing the mixture into the mold box.

The problem to be solved therefore is to construct a molding machine which will satisfactorily mold sticky self-setting mold material in a mold box and which will be repeatable cycle after cycle in production use in a foundry. The solution to the problem is to provide a cleanable mold machine wherein the magazine and blow head is properly cleaned after each cycle of operation by a fluid directed through the magazine and out an enabled diverter passage just outboard of the blow aperture in the mold box.

SUMMARY OF THE INVENTION

The invention may be incorporated in a molding machine having a mold box with a mold cavity and a blow aperture thereinto, a magazine having an air pressure inlet and a mold material outlet and adapted to contain a predetermined quantity of self-setting mold material, said magazine and mold box having an investment position of a flow path of mold material from the magazine outlet to the mold box blow aperture, and blow means connected to supply air under pressure to the magazine air pressure inlet to blow the mold material from the magazine through the blow aperture with the magazine and mold box in the investment position, the improvement of, a diverter having a diverter passage, movable means connected to enable and disable said diverter passage, said diverter passage being disabled during blow of the mold material from said magazine into said cavity, and said movable means being movable to enable said diverter passage to direct a fluid through said enabled diverter passage to divert any mold material remaining outboard of said mold box blow aperture after blowing said cavity and blow aperture full.

The cleanable molding machine includes fluid jets directed downwardly in the magazine toward the magazine outlet to blow the mold material toward the outlet. Also some of these fluid jets are directed substantially tangentially to the wall of the magazine to move the mold material inwardly and in a partially rotary motion to aid the movement of the sand into the mold box and to help clean the magazine.

An object of the invention is to provide a molding machine which may be used with sticky self-setting mold material and which is properly cleaned after each cycle of operation.

Another object of the invention is to provide a diverter wherein an enabled diverter passage diverts any excess sand remaining outboard of the mold box during each cycle and after the blow operation is completed.

Another object of the invention is to provide fluid jets within the magazine to move the sand and clean the magazine and the fluid jets divert any excess sand out an enabled diverter passage.

Other objects and a fuller understanding of the invention may be had by referring to the following description and claims, taken in conjunction with the accompanying drawing.

DESCRIPTION OF THE PREFERRED EMBODIMENTS

Figure 1:
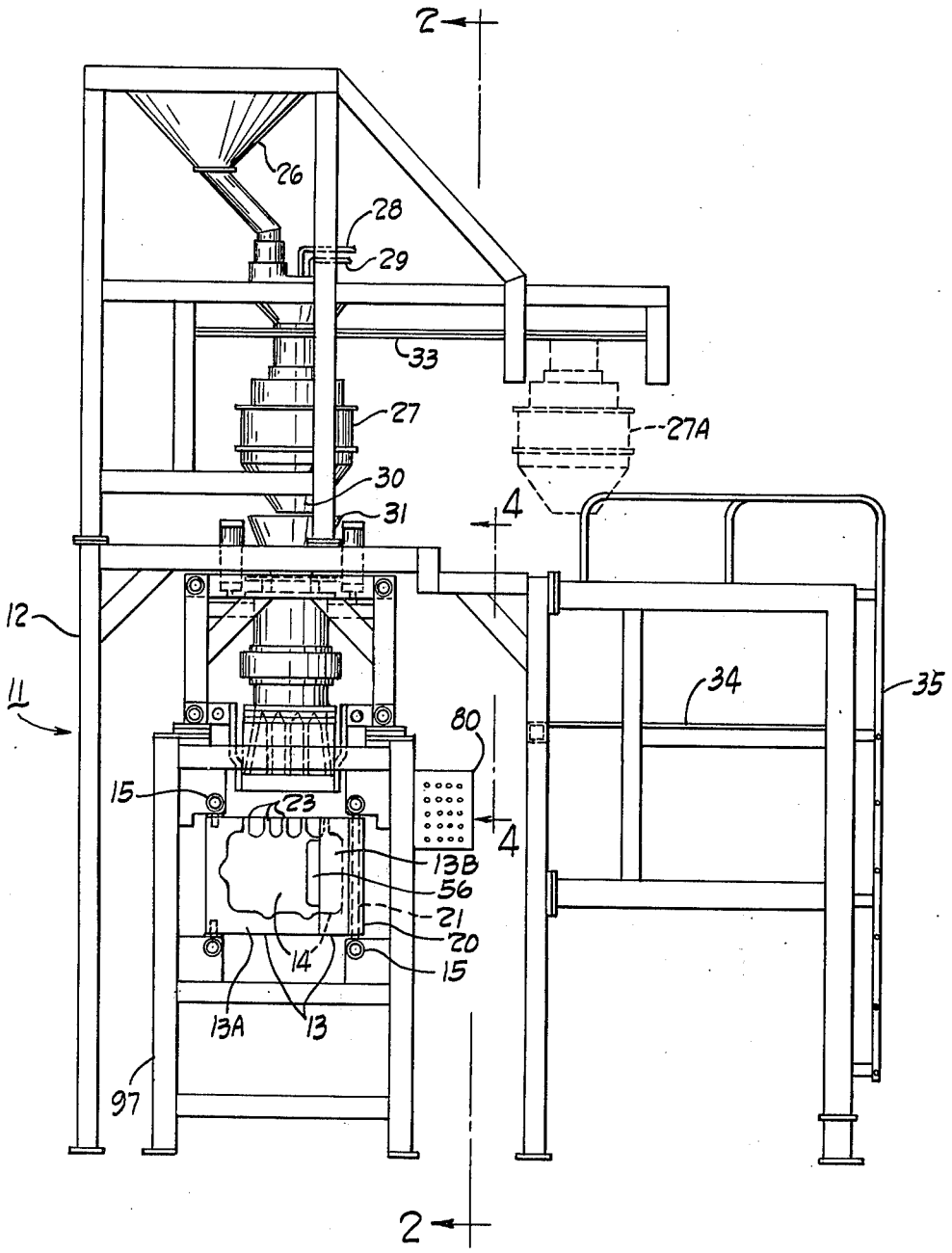
FIG. 1 is an end elevational view of the complete mold making machine.

FIGS. 1-5 illustrate a preferred embodiment of the invention as incorporated in a molding machine 11 having a frame 12 mounting a mold box 13. The mold box 13 may have one of many different forms, for example, flaskless molding of cope and drag molds using a pattern board with two halves of the pattern thereon, it may be just a single cope or drag mold with a flat plate to close off the cavity, or as illustrated it may be a core box having core box halves 13A and 13B. The mold box 13 has a cavity 14 in which the mold or core is formed and hereinafter this shall be termed a mold whether it is a cope or drag mold or a core which is being formed. The mold box 13 is openable in some manner and in this preferred embodiment the frame carries four tie rods 15 horizontally disposed on which the mold box 13A is reciprocably movable. The mold box 13A is movable on the tie rods 15 by means of a ram 16 moving a connecting rod 17 connected to a nut having a handwheel 18 and the nut fitted on a screw 19 connected to the mold box 13A. The mold box 13B is mounted on a door 20 swinging on a hinge pin 21 on the frame 97.

Figure 2:
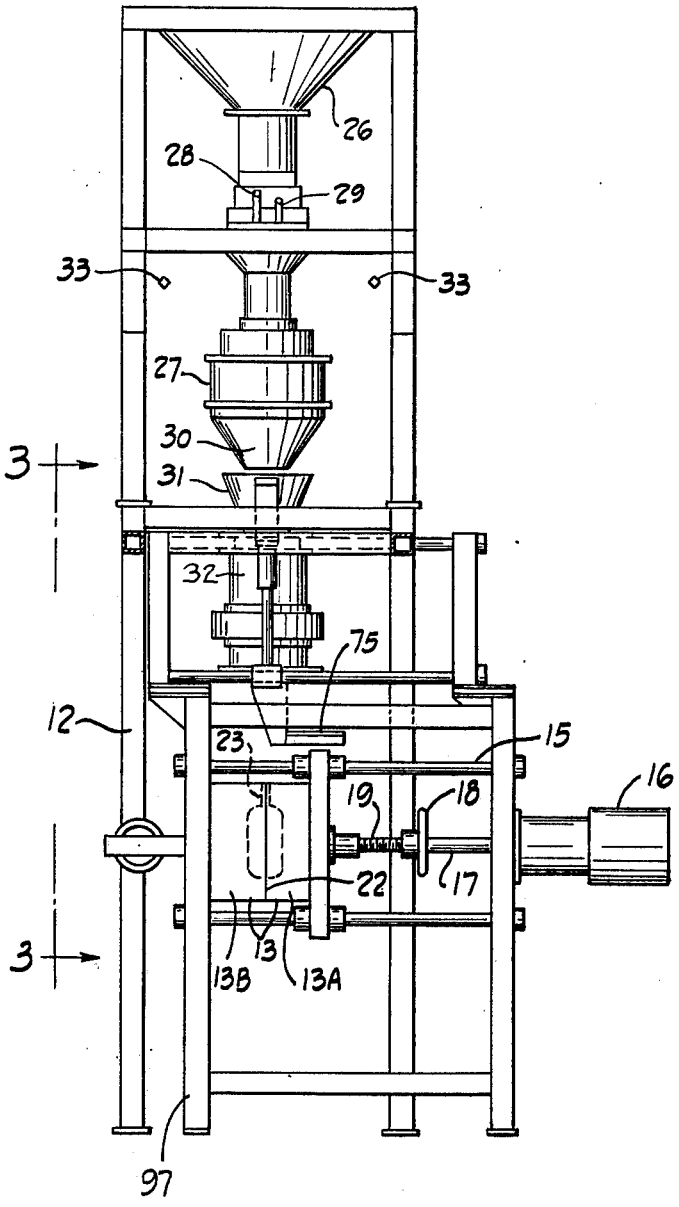
FIG. 2 is a sectional view of the machine on line 2—2 of FIG. 1.

FIG. 2 of the drawing illustrates the two mold box halves 13A and 13B in the closed position and having a parting line 22. The mold box has one or more blow apertures 23, in this case disposed at the top of the mold box 13 along the parting line 22.

Raw sand is fed to a hopper 26 by any suitable means such as an overhead crane and from there is directed to a rotary mixer 27. This may be of the type shown in U.S. Pat. No. 3,881,703 wherein a liquid adhesive and a liquid catalyst are supplied through conduits 28 and 29, respectively. This rotary mixer 27 has the capability of rapid acceleration and precise control of the flow of the sand, resin adhesive, and catalyst so that a predetermined quantity of sticky self-setting mold material mixture may be supplied out the outlet 30 of the mixer 27 to a hopper 31 where it falls into a magazine 32. The mixer 27 is adjustably mounted on rails 33 so that it may be moved from the position shown in FIG. 1 to a dotted line position 27A adjacent a service platform 34 which is accessible by a ladder 35. This access is primarily for calibration and periodic cleaning of the rotary mixer 27 and normally the mixer will be in the full line position of FIG. 1 to dispense the mold material into the hopper 31.

Figure 3:
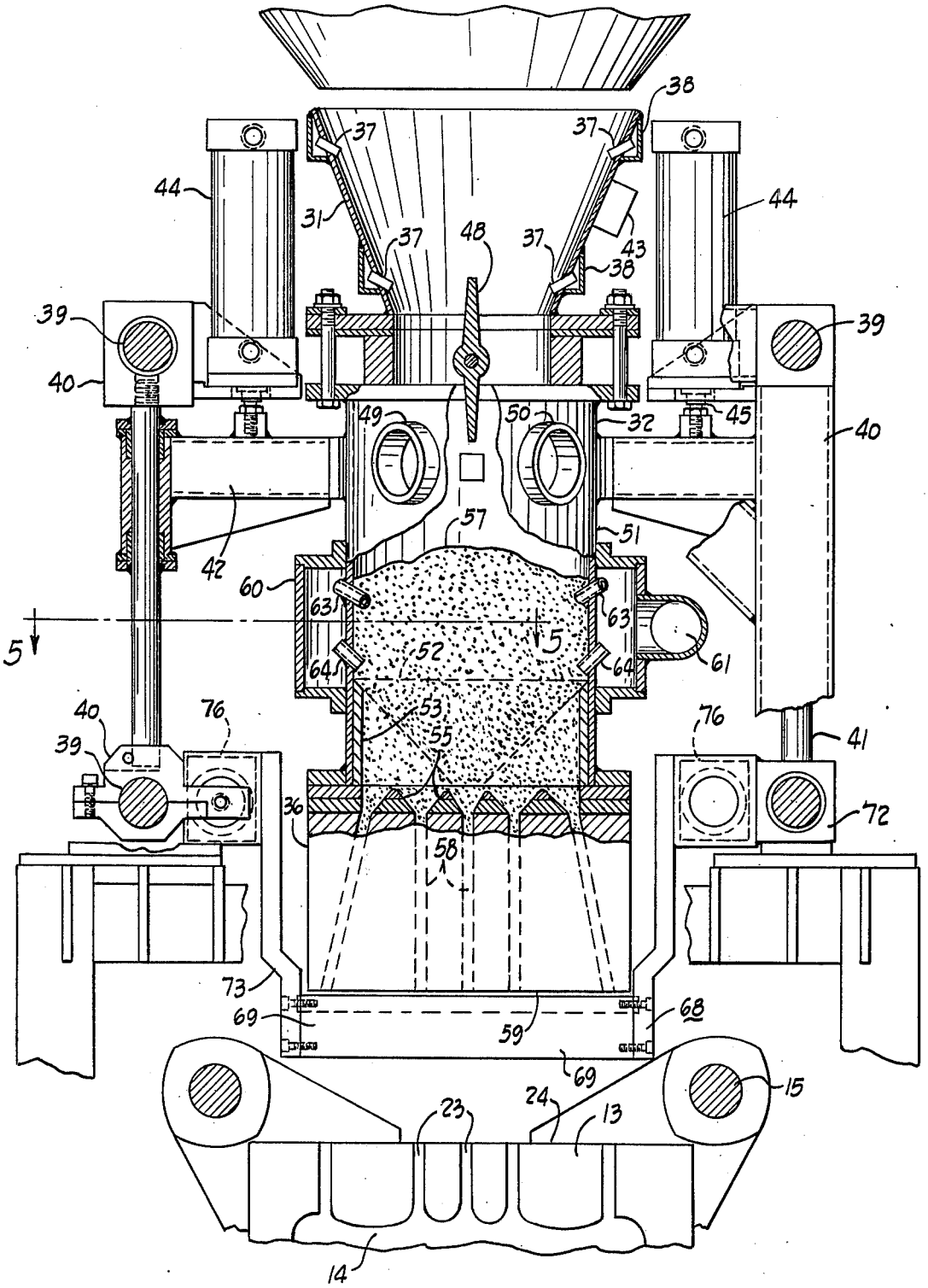
FIG. 3 is an enlarged partial view, partly in section, on line 3—3 of FIG. 2.
Figure 4:
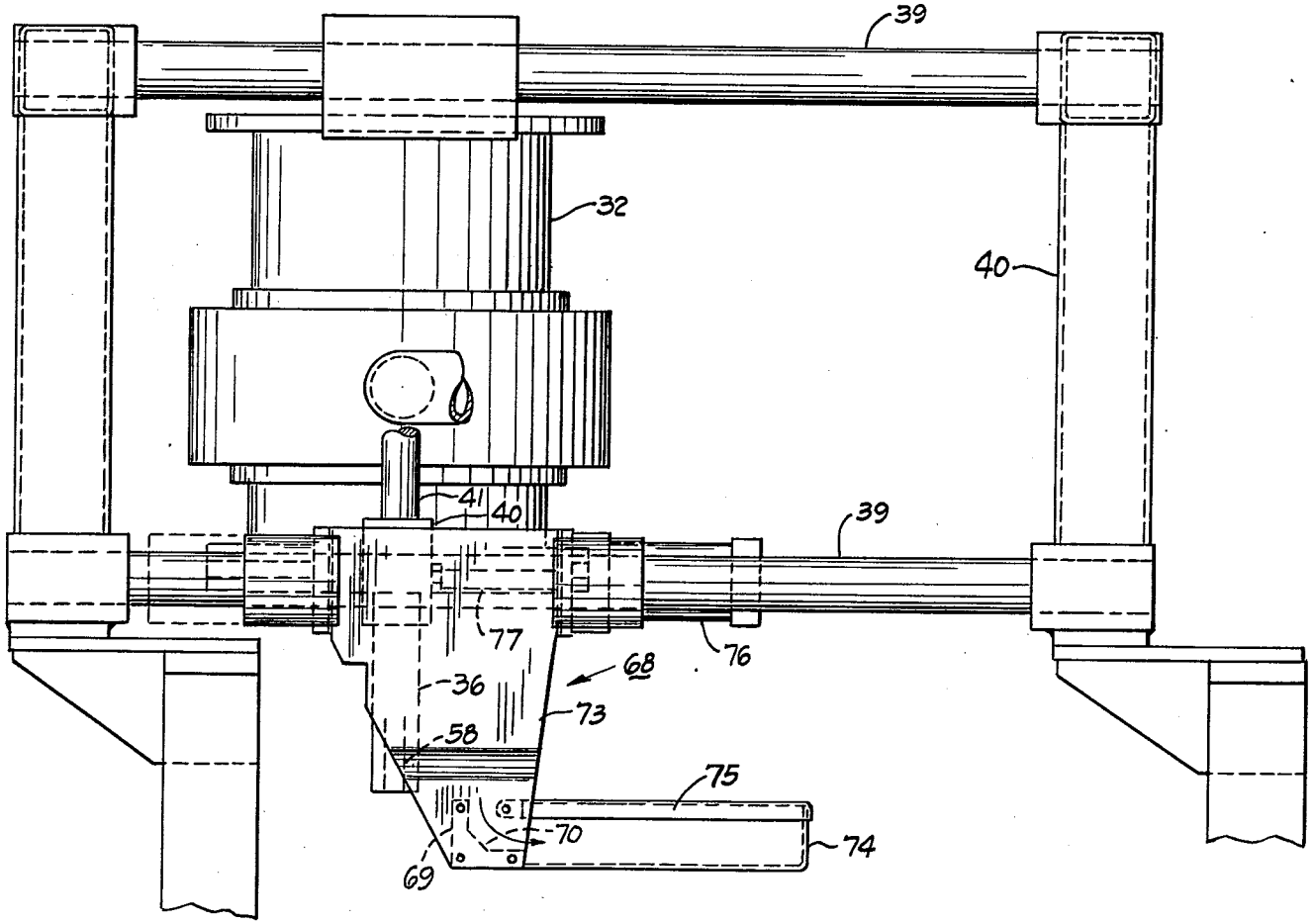
FIG. 4 is partial side view on line 4—4 of FIG. 1.
Figure 5:
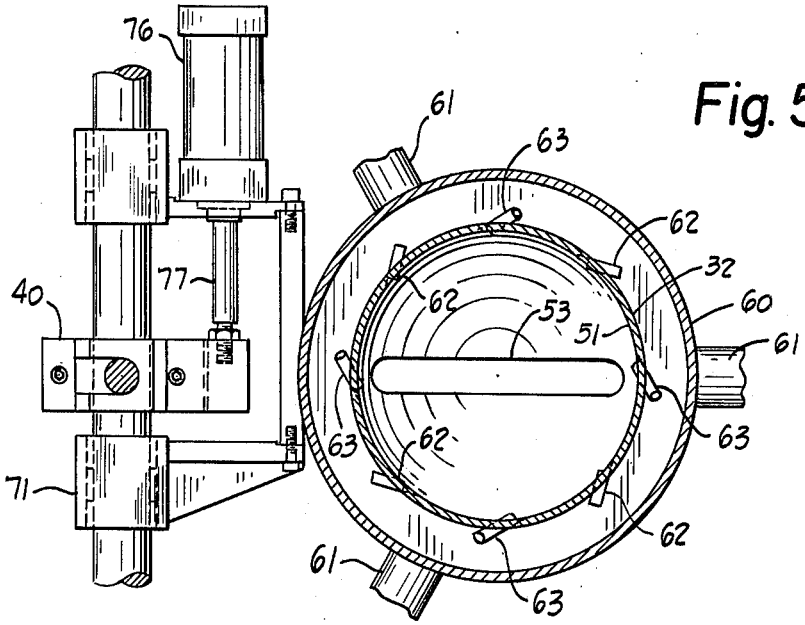
FIG. 5 is a partial sectional view on line 5—5 of FIG. 3.

FIGS. 3, 4 and 5 better show the details of construction of the magazine 32 and a blow head 36. A second group of four tie rods 39 is provided parallel to and above the first group of tie rods 15. A movable mount 40 is slidably journaled on these tie rods 39 to be horizontally adjustable so that the center line of the magazine 32 coincides with the parting line 22. This is an adjustment during set-up depending upon the thickness of the mold boxes 13A and 13B. The movable mount 40 has two vertical rods 41 slidably journalling a carriage 42. This carriage carries the magazine 32 for vertical movement. A pair of fluid cylinders 44 are fixed on the movable mount 40 and the piston rods 45 of the fluid motors 44 are connected to the carriage 42 to provide movement thereof.

The upper portion of the magazine 32 is fitted with a butterfly valve 48 to close the upper part of the magazine after the mold material is fed into it. Air jets 37 leading from air chambers 38 near the top and near the bottom of the hopper 31 work together with a vibrator 43 to free the hopper 31 and butterfly valve 48 of any mold material 57 after filling of the magazine 32 from the mixer 27. A large blow valve 49 for admitting a fluid such as air is provided at the upper end of the magazine 32 just below the valve 48 and also a quick exhaust valve 50 is provided in the upper part of this magazine. The magazine 32 has an annular wall 51 which is preferably cylindrical. A conical insert 52 is provided in the bottom of the magazine 32 to direct mold material inwardly as it moves downwardly and a wide slot 53 is cut vertically in this conical insert 52. This wide slot is adapted to lie vertically over the parting line 22 and to have a flow path communication therewith through the blow head 36. The flow path may be horizontal or at an angle, but is shown as being vertical. It will be understood that the molding machine 11 will be used with many different mold boxes 13 throughout its productive life and the blow head 36 is a means of providing this flow path communication from the magazine 32 to the core box 13. The blow head 36 may be a simple blow plate having apertures to mate with the blow apertures 23 but usually the blow head is more complex in order to be able to distribute properly the mold material among the various blow apertures 23 so as to be certain to properly fill the cavity 14. These blow apertues 23 extend from the cavity 14 to the upper surface 24 of the mold box 13, which in the preferred embodiment is a horizontal surface. In this preferred embodiment the blow head 36 is shown as having pointed dividers 55 at the top of this blow head where it is secured to the bottom of the magazine 51 for a particular set-up to make certain mold 56 within the cavity 14. These dividers 55 direct the mold material 57 to channels 58 within the blow head 36 and the lower end of these channels 58 are adapted to mate with the blow apertures 23. The fluid motors 44 may be actuated to lower the magazine 32 and blow head 36 to an investment position whereat the channels are in communication with the blow apertures 23.

An air chamber 60 surrounds the cylindrical wall 51 of the magazine 32 just above the conical insert 52. This air chamber 60 is provided with at least one and preferably three blow valves 61 to admit fluid under pressure, for example, air. The air from this air chamber flows to the interior of the magazine 32 through fluid jets 62, 63 and 64. There are a plurality of jets 62 and a plurality of jets 63 in an upper level. The jets 62 are directed substantially tangentially to the cylindrical wall 51. The jets 63 are directed substantially tangentially and also directed downwardly at about a 30° angle. The jets 64 are in a lower level and preferably are directed at a 45° angle downwardly into the magazine 32. The purpose of the tangentially disposed jets 62 and 63 is to give a partial rotary motion to the slug of mold material 57 and also to help break it loose from the interior wall 51 and cone 52. The purpose of the downwardly directed jets 63 and 64 is to help move the slug of mold material 57 downwardly from the magazine 32 through the conical insert 52 and into the channels 58.

A clean-out device 68 is provided which includes a diverter 69. This diverter is box shaped and has a diverter passage 70 which is transverse to the vertical flow path of the mold material during investment of the cavity 14. The cleanout device 68 includes first and second U-shaped frames 71 and 72. Frame 71 is slidable on one of the lower tie rods 39 and U-shaped frame 72 is slidable horizontally on the other lower tie rod 39. A third U-shaped frame 73 is carried on the frames 71 and 72 with the diverter 69 making up the lower portion of this third U-shaped frame 73. A covered receptacle 74 for excess or waste mold material 57 is mounted on one side of the diverter box 69 at the outlet of the diverter passage 70. This covered receptacle may contain a removable liner accessible through a hinged cover 75. Fluid motors 76 are mounted for movement on the U-shaped frames 71 and 72 and the piston rods 77 of these motors 76 are fixed to the movable mount 40. A control means 80 is utilized to control the various movements in the cycle of operation as controlled by the usual limit switches, not shown.

OPERATION

The cycle of operation of the molding machine 11 may be described starting at most any point in the cycle since the cycles are repetitive. Assuming that the mold box cavity 14 is empty, the ram 16 is energized by the control means 80 to close the mold box halves 13A and 13B to establish this cavity 14. Next the fluid motors 44 are actuated to move the magazine 32 and blow head 36 downwardly until the blow head 36 is clamped on the upper surface 24 of the mold box 13. Thus the lower surface 59 of the blow head 36 is clamped to the upper surface 24 of the mold box 13. This is the investment position whereat the channels 58 communicate with the blow apertures 23 to provide a generally vertical flow path for the mold material 57.

Next the rotary mixer 27 is actuated with sand, resin adhesive, and catalyst being fed thereto and mixed to become the mold material 57. This will provide a self-setting mold material which in many cases is sticky and difficult to move because it tends to adhere to practically all surfaces. The mold material falls into the hopper 31 and through the open butterfly valve 48 into the interior of the magazine 32. The rotary mixer is capable of filling the magazine with an accurately predetermined quantity of mold material in a very short time, depending on size of the cavity 14, e.g. at the rate of over five pounds per second. After the mixer 27 has delivered the predetermined quantity it is turned off. The air jets 37 and vibrator 43 are activated to clean the hopper 31 of the mold material. Next the butterfly valve 48 is closed to seal the top of the magazine 32. The blow valves 61 are opened to blow air through the jets 62–64 and then the blow valve 49 is opened. Preferably the air chamber is pressurized before pressurizing magazine 31 at a higher pressure, e.g. 15 psi higher, than the pressure in the upper interior of the magazine 32. This assures that air flows from the air chamber 60 through the jets 62–64 into the magazine, rather than sand flowing from the magazine into the air chamber. This sudden application of pressure on the top of the mold material 57 and the even higher air pressure applied through the jets 62 and 64 moves the mold material as a slug in a rotary and downward motion through the conical insert 52, the slot 53, the channels 58 and the blow apertures 23 to fill the cavity 14. This blowing may be accomplished in less than two seconds, depending on quantity. Accordingly only a short period of time, in the order of five to thirty seconds has elapsed since the liquid resin and liquid catalyst first contacted the sand to become the sticky mold material before this mold material is invested in the cavity 14. This self-setting mold material may begin to set or cure within thirty to sixty seconds so the present mold machine accomplishes the desired objective of sufficiently rapid filling of the cavity and emptying of the magazine 32 before the mold material has a chance to begin setting or curing. The blow valve 49 preferably closes slightly before the blow valves 61 to keep the air chamber 60 free of mold material.

The rotary mixer 27 has the capability of providing an accurately measured quantity of mold material 57 within about 0.5 percent of the desired quantity. This is by carefully regulating the air pressure, speed and timing of the rotary mixer and controlling the air pressure on the blow valves 49 and 61. After the cavity 14 is filled there may be about 0.5 percent excess of mold material 57 in the channels 58 of the blow head 36, namely, that excess will be outboard of the cavity 14 and blow apertures 23.

The cleanout device 68 is next utilized. The fluid motors 44 are reversed to raise the magazine 32 to the position shown in FIG. 3. Next the fluid motors 76 are actuated to move the diverter 69 from the full line position shown in FIG. 4 to the left until the diverter 69 is on the center line of the parting line 22. The fluid motors 44 are then energized to move the magazine 32 downwardly slightly to clamp the lower surface 59 of the blow head 32 onto the diverter 69. This enables the diverter passage 70. Next a cleaning fluid is moved through the channels 58 and the diverter passage 70. In this preferred embodiment the cleaning fluid is air and conveniently the blow valves 49 and 61 may again be actuated to blow air downwardly and tangentially in the magazine 32 and through the channels 58 to divert any excess mold material 57 into the receptacle 74. The hinged cover 75 may conveniently be provided with a screen or apertures to permit this exhaust of air. Thus this cleanout device 68 is quickly and easily actuated to clean out any excess mold material 57 from the molding machine 11 so that it is ready for the next cycle of operation. To complete the cycle, the fluid cylinders 44 move upwardly to unclamp the diverter 69 and the fluid motors 76 move the diverter 69 to the full line position shown in FIG. 4. This is the disabled condition or position for the diverter passage 70 so that the flow path for investment of the cavity 14 may again be established in the next cycle of operation.

Figure 6:
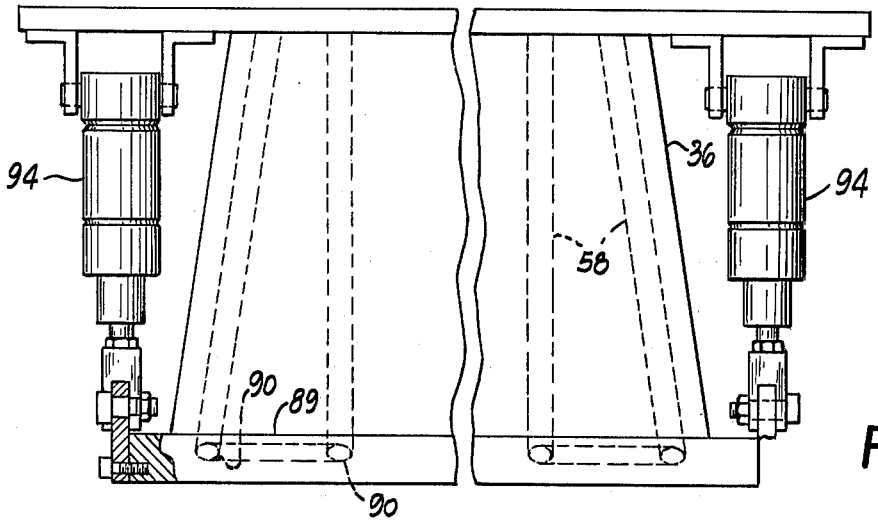
FIG. 6 is a view similar to FIG. 3 but of a modification.
Figure 7:
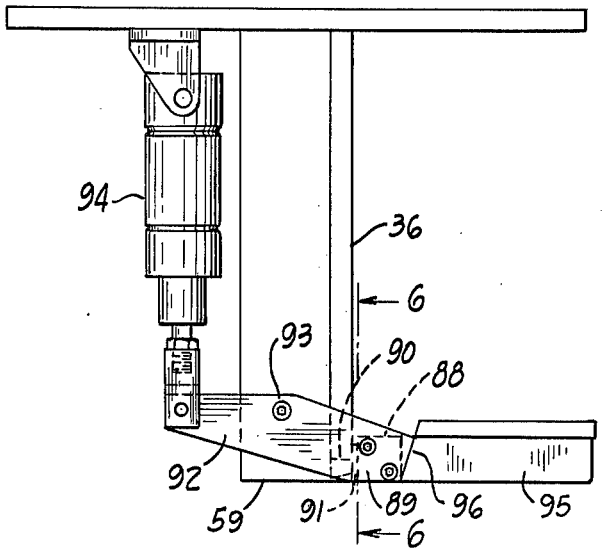
FIG. 7 is a view similar to FIG. 4 but of the modification of FIG. 6.

EMBODIMENT OF FIGS. 6 and 7

FIGS. 6 and 7 show an alternative cleanout device 88. This cleanout device may be utilized with the same blow head 36 and magazine 32, with the magazine not being shown in FIGS. 6 and 7. The cleanout device 88 includes a diverter valve 89 having a valve packing 91 covering a diverter passage 90. The diverter valve 89 is an elongated bar and the packing 91 is elongated to cover one entire side of this bar so that it may engage all of the diverter passages 90 which are in continuous communication with the lower end of the channels 58. The diverter valve bar 89 is mounted on levers 92 pivoted at 93 on the lower end of the blow head 36. Fluid motors 94 mounted relative to the blow head 36 actuate the other end of the levers 92 to open and hence enable the diverter passages 90 or to close and hence disable these diverter passages.

OPERATION

The cycle of operation may be quite similar to that described for the embodiment of FIGS. 1–5. The lower surface 59 of the blow head 36 will be clamped to the mold box 13 for investment of the cavity 14. Immediately after completion of filling of the cavity 14 and the blow apertures 23, the fluid motors 94 are actuated to open the diverter valve 89. This enables diverter passages 90 and the fluid cleaning takes place. The air blows any excess mold material 57 out through the diverter passages 90 into the covered receptacle 95. This receptacle has an inlet 96 uncovered by the upward movement of the diverter valve 89 so that the excess mold material 57 will be deposited in this receptacle 95. This embodiment of FIGS. 6 and 7 has the advantage of even quicker ridding the machine of excess mold material 57 because it is not necessary to unclamp the blow head 36 and mold box 13, separate them, and insert the diverter 69. Air pressure during the cleanout is applied to the top of the blow apertures 23 but this is not a liability it is an asset to make sure that the cavity 14 is filled.

The molding machine 11 in the two preferred embodiments accomplishes the desired result of being able to utilize self-setting mold material which very often is a sticky material which does not wish to flow readily because it adheres to most all surfaces. The rotary mixer quickly mixes the sand, resin and catalyst and deposits it in the magazine 32. From there it is quickly blown into the cavity 14. Within a very short time thereafter in the order of one or two seconds, the diverter passage 70 or 90 is enabled and a fluid cleanout is activated. In the preferred embodiment this fluid is air and conveniently may utilized these same blow valves 49 and 61 as used during investment of the cavity 14. This fluid such as air cleans out any excess stickly mold material before it has a chance to set in the rather restricted channels 58 or before it has a chance to set in any part of the magazine 32. The fluid jets 62, 63 and 64, by aiding the inward and downward movement of the mold material and also giving it a partial rotary motion, assure that the mold material does not cling to the inner surface of the cylindrical wall 51 but instead is moved downwardly and out through the magazine outlet, through the blow head 36 into the cavity 14. It is only the very small amount of possible excess mold material which needs to be expelled through the diverter passages 70 or 90. This keeps the machine clean each cycle so that high production rates of completed molds 56 may be achieved.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spriit and the scope of the invention as hereinafter claimed.

We claim:

1. In a molding machine having a mold box with a mold cavity and a blow aperture thereinto, a magazine having an air pressure inlet and a mold material outlet and adapted to contain a predetermined quantity of mold material, said magazine and mold box having an investment position of a flow path of mold material from the magazine outlet to the mold box blow aperture, and blow means connected to supply air under pressure to the magazine air pressure inlet to blow the mold material from the magazine through the blow aperture with the magazine and mold box in the investment position, the improvement of, a diverter having a diverter passage, movable means connected to enable and disable said diverter passage and when enabled being positioned to receive mold material from said magazine outlet, said diverter passage being disabled during blow of the mold material from said magazine into said cavity, and said movable means being movable to enable said diverter passage to direct a fluid through said enabled diverter passage to divert any mold material remaining outboard of said mold box blow aperture after blowing said cavity and blow aperture full.

2. A machine as set forth in claim 1, wherein said diverter passage is transverse to the flow path of mold material from the magazine outlet to the mold box blow aperture.

3. A machine as set forth in claim 1, wherein said diverter is continuously connected in the flow path of mold material from the magazine outlet to the mold box blow aperture.

4. A machine as set forth in claim 1, wherein said movable means is connected to move said diverter between first and second positions corresponding to the enabled and disabled diverter passage, respectively.

5. A machine as set forth in claim 1, including a blow head having plural passages therein, said mold box having a plurality of blow apertures spaced to mate with said plural passages of said blow head in said investment position, and said flow path being through all of said passages in said blow head.

6. A machine as set forth in claim 5, including plural diverter passages one each in communication with said plural passages in said blow head upon said diverter passages being enabled.

7. A machine as set forth in claim 1, wherein said diverter is a block having said diverter passage as a transverse passage therein, and said movable means moving said block to a position between said magazine outlet and said mold box to enable said diverter passage by diverting flow of mold material from the magazine outlet out said diverter passage.

8. A machine as set forth in claim 1, wherein said molding machine includes motive means urging toward each other said magazine outlet and said mold box to establish said investment position, said motive means being reversible to move said magazine away from said mold box, and said diverter passage being enabled by the diverter being movable into position between said magazine outlet and said mold box and said motive means urging said magazine toward said mold box with said diverter therebetween.

9. A machine as set forth in claim 1, wherein said diverter passage is transverse to the flow path of the mold material from the magazine outlet to the mold box blow aperture and is in constant communication therewith, and said movable means including a valve closing said diverter passage and movable to open said diverter passage to enable said diverter passage.

10. A molding machine comprising, in combination, a frame, a mold box mounted on said frame, means connected to open and close said mold box, said mold box in the closed condition having a mold cavity with a blow aperture, a magazine having an air pressure inlet and a mold material outlet, means to fill said magazine with a predetermined quantity of mold material, a diverter having a diverter passage, means connected to enable and disable said diverter passage and when enabled being positioned to receive mold material from said magazine outlet, means including said disabled diverter passage to establish an investment position of a flow path of mold material from said magazine outlet to said mold box blow aperture, said enabled diverter passage being transverse to the flow path of mold material from said magazine to said cavity, blow means connected to supply air under pressure to said magazine air pressure inlet to blow the mold material from the magazine through said blow aperture into said cavity with said magazine and mold box in said investment position and said diverter passage disabled, and cleaning means to direct a fluid through said enabled diverter passage to divert any mold material remaining outboard of said mold box blow aperture after blowing said cavity and blow aperture full.

11. A mold machine as set forth in claim 10, wherein said magazine includes fluid jets directed downwardly and toward said magazine outlet to blow the mold material toward said outlet.

12. A mold machine as set forth in claim 10, wherein the wall of said magazine is annular in cross section, and fluid jets directed substantially tangentially to the annular wall of the magazine to move the mold material inwardly away from the wall and in a partially rotary motion.

13. A mold machine as set forth in claim 10, wherein said magazine has a generally cylindrical wall, an air chamber surrounding said cylindrical wall, and a plurality of air jets directed downwardly from said air chamber into said magazine.

14. A mold machine as set forth in claim 10, wherein said magazine has an annular wall, and a plurality of air jets disposed in first and second horizontal planes one above the other and directing air into said magazine.

15. A mold machine as set forth in claim 14, wherein the fluid jets in the upper plane include jets disposed substantially tangentially to the annular wall of said magazine.

16. A mold machine as set forth in claim 14, wherein the jets in said upper plane include first and second groups, said first group of jets being substantially tangential to the annular wall of said magazine, and the jets in said second group being disposed downwardly into said magazine.

* * * * *